US005119704A

United States Patent [19]

Wolfson

[11] Patent Number: 5,119,704

[45] Date of Patent: Jun. 9, 1992

[54] COMBINED CUTTING MACHINE AND TAKE-OFF TABLE

[75] Inventor: Lawrence S. Wolfson, West Hartford, Conn.

[73] Assignee: Gerber Garment Technology, Inc., Tolland, Conn.

[21] Appl. No.: 681,860

[22] Filed: Apr. 5, 1991

[51] Int. Cl.[5] ..... B65H 29/00

[52] U.S. Cl. ..... 83/155; 83/110; 83/157; 83/859; 83/941

[58] Field of Search ..... 83/155, 939, 940, 941, 83/859, 157, 451, 110, 155.1; 108/133

[56] References Cited

U.S. PATENT DOCUMENTS

| | | | |
|---|---|---|---|
| 236,197 | 1/1881 | Valley | 108/133 |
| 3,916,742 | 11/1975 | Biernot | 83/157 X |
| 3,933,067 | 1/1976 | Clark | 83/155 |
| 4,068,551 | 1/1978 | Kreitz | 83/859 X |
| 4,080,855 | 3/1978 | DeGeorge et al. | 83/157 X |
| 4,419,913 | 12/1983 | Schütt et al. | 83/940 X |
| 4,747,329 | 5/1988 | Lukens, Jr. | 83/939 X |
| 4,790,224 | 12/1988 | Krutilla et al. | 83/155 X |
| 4,919,027 | 4/1990 | Littleton | 83/110 X |
| 5,042,339 | 8/1991 | Gerber | 83/940 X |

*Primary Examiner*—Frank T. Yost
*Assistant Examiner*—Kenneth E. Peterson
*Attorney, Agent, or Firm*—McCormick, Paulding & Huber

[57] ABSTRACT

A machine for cutting cloth or similar sheet material for a take-off table permanently connected to it for supporting sheet material after its having been cut by the cutting machine. The table is movable relative to the machine between a deployed and a stowed position, and in the stowed position of the table the combined apparatus has an overall length much shorter than it has with its table deployed, thereby allowing the apparatus to be more easily moved from one spot to another or the cutting room floor.

6 Claims, 3 Drawing Sheets

COMBINED CUTTING MACHINE AND TAKE-OFF TABLE

BACKGROUND OF THE INVENTION

This invention relates to apparatus for cutting sheet material, such as fabric for making clothing or upholstery, and deals more particularly with a cutting machine having combined with it a take-off table for supporting material already cut by the cutting machine so as to permit a quantity of cut work material to be moved to the take-off table for the step, for example, of separating the desired cut pieces from the waste, while another quantity of work material is cut by the cutting machine.

The apparatus of this invention has particular utility in garment cutting rooms where a single automatically controlled cutting machine is used in combination with a number of spreading tables onto which lay-ups of sheet material are spread preparatory to their being cut. When one spreading table has a lay-up ready for cutting the cutting machine is moved to it, and the lay-up is shifted from it to the cutting machine, either all at once or progressively depending on the length of the lay-up, for cutting by the cutting machine. After the cutting of that lay-up is finished and the cut lay-up is conveyed off the cutting table the cutting machine is moved to another spreading table having another lay-up ready for cutting. Thereafter such process is continually repeated with the cutting machine moving from one spreading table to another in accordance with some production schedule.

In the above described cutting procedure it is also known to use take-off tables with the cutting machine to hold the sheet material after it has been cut by the cutter and while subsequent handling of it takes place such as the separation of desired cut pieces from the waste material and the delivery of the cut pieces and the waste material to different destinations.

In the past the take-off tables have often been separate from the cutting machines and have essentially been stand alone units having their own motors and control devices. Therefore, each time the cutting machine is moved to a new spreading table it has been necessary to spend some effort and time in associating the cutting machine with a take-away table at the new location.

A drawback in permanently combining a cutting machine with a take-off table is that the combination has a relatively long length and many cutting rooms have closely spaced structural pillars or posts making it difficult to move such a long apparatus from one location to another.

The general object of this invention is, therefore, to provide a combined cutting machine and take-off table wherein the take-off table is permanently connected with the cutting machine making it unnecessary to disconnect and reconnect the cutting machine to a take-off table each time it is moved to a new location on the cutting room floor.

A further object of the invention is to provide a combined cutting machine and take-off table wherein the take-off table is movable between a deployed and a stowed position relative to the cutting machine with the combined apparatus in the stowed position of the take-off table having a substantially shorter length then it does when the take-off table is in its deployed position, thereby permitting the combined apparatus to be more easily moved from one spot to another.

A still further object of the invention is to provide a combined cutting machine and take-off table as defined in the preceding paragraph wherein the take-off table in its stowed position is vertically inclined relative to the cutting machine and wherein in the stowed position of the take-off table one of its ends is in a lower position than it is in the deployed position of the take-off table to reduce the overall height of the apparatus when the take-off table is stowed in comparison to the overall height it would have if such lowering of one end did not occur.

Other advantages and objects of the invention will be apparent from the following detailed description of a preferred embodiment of the invention taken in conjunction with the accompanying drawings and appended claims.

SUMMARY OF THE INVENTION

The invention resides in a combined cutting machine and take-off table for cutting fabric and similar sheet material. The cutting machine has a machine frame and means, such as an endless conveyor member, carried by the frame providing an upwardly facing flat horizontal supporting surface for supporting sheet material to be cut. The take-off table includes a table frame and a means carried by that frame providing a second flat supporting surface for supporting sheet material cut by the cutting machine. The take-off table frame is connected to the cutting machine frame by a linkage means permitting the take-off table to move between a deployed position and a stowed position relative to the cutting machine. In the deployed position the supporting surface of the take-off table is co-planar with and essentially forms a continuation of the supporting surface of the cutting machine. In the stowed position of the take-off table it is so positioned that the overall length of the combined apparatus is substantially shorter then it is when the take-off table is in its deployed position. Preferably, when stowed the take-off table is vertically inclined to the supporting surface of the cutting machine and one of its ends is located in a dropped position located a substantial distance below the supporting surface of the cutting machine to reduce the overall height of the apparatus.

DETAILED DESCRIPTION OF THE PREFERRED EMBODIMENT

Figure 1:
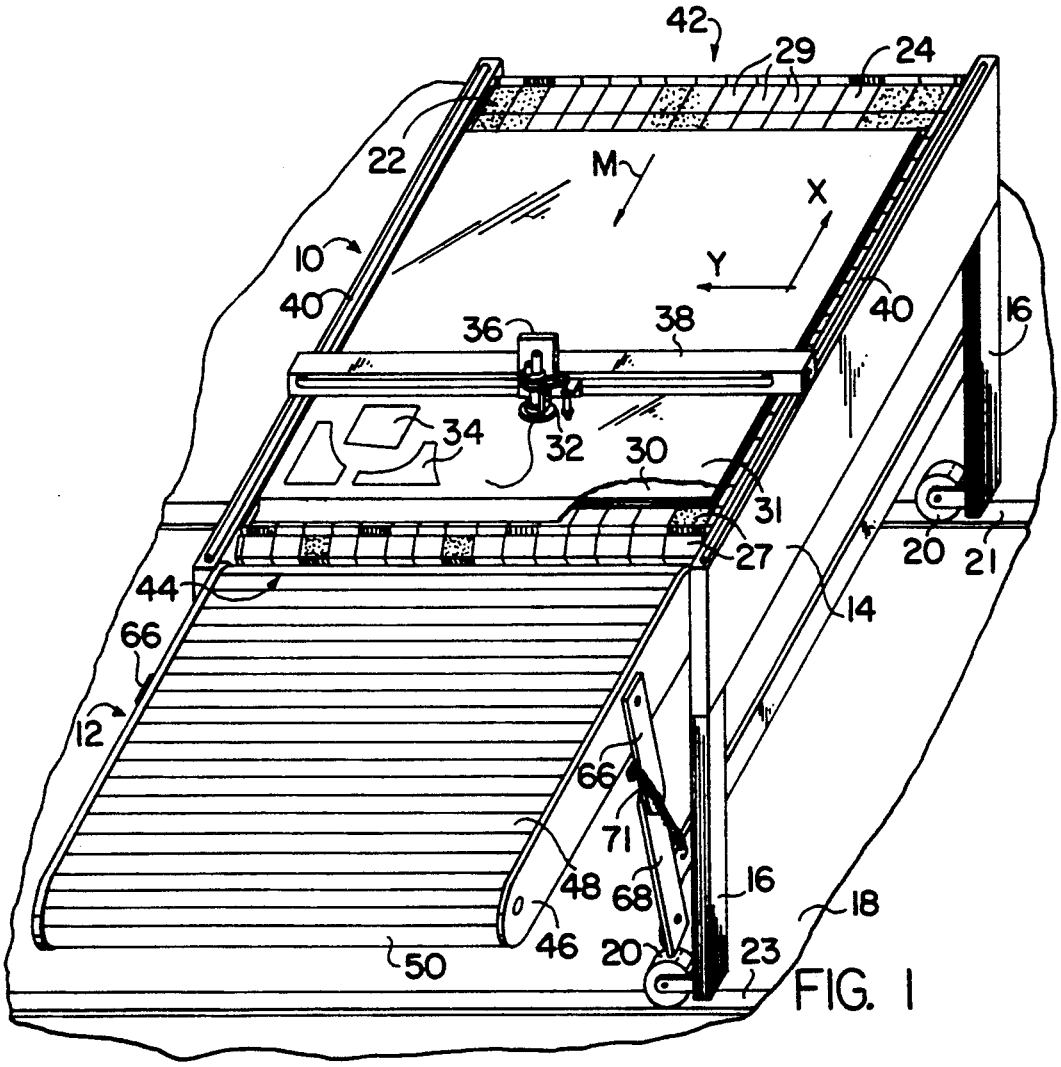
FIG. 1 is a perspective view showing a combined cutting machine and take-off table embodying this invention.

Turning to the drawings, and first referring particularly to FIG. 1, an apparatus embodying the invention is there shown and consists of a cutting machine, indicated generally at 10, combined with a take-off table, indicated generally at 12. As to the details of their construction, both the cutting machine 10 and the take-off table 12 may vary widely without departing from the invention. The cutting machine 10, however, is preferably one such as shown by the patent application being filed concurrently herewith by Heinz Joseph Gerber and Lawrence Wolfson and entitled CONVEYOR APPARATUS FOR SUPPORTING AND ADVANCING SHEET MATERIAL, to which application reference may be had for a more complete description of the cutting machine 10.

For the present purposes it is sufficient to note that the cutting machine 10 includes a frame 14 having a number of legs 16, only two of which are shown in FIG. 1, for supporting the frame from a floor 18. To allow the machine 10, and its attached take-off table 12, to be moved from one location to another on the floor 18, the frame 14 carries a number of wheels 20, only two of which are shown in FIG. 1. The wheels 20 are mounted to the frame and one set (two or more wheels) are provided with guide flanges so as to mesh with a guide track 21 attached to the floor 18 so as to assure proper orientation of the machine 10 when it docks with a spreading table. One of the flanged wheels can be powered to provide lateral movement of the machine. The other, non-flanged wheels 20 preferably ride on another track 23 attached to the floor. If it is desired to be able to fix the machine against rolling movement relative to the tracks 21 and 23 some or all of the wheels may be provided with brakes.

Figure 2:
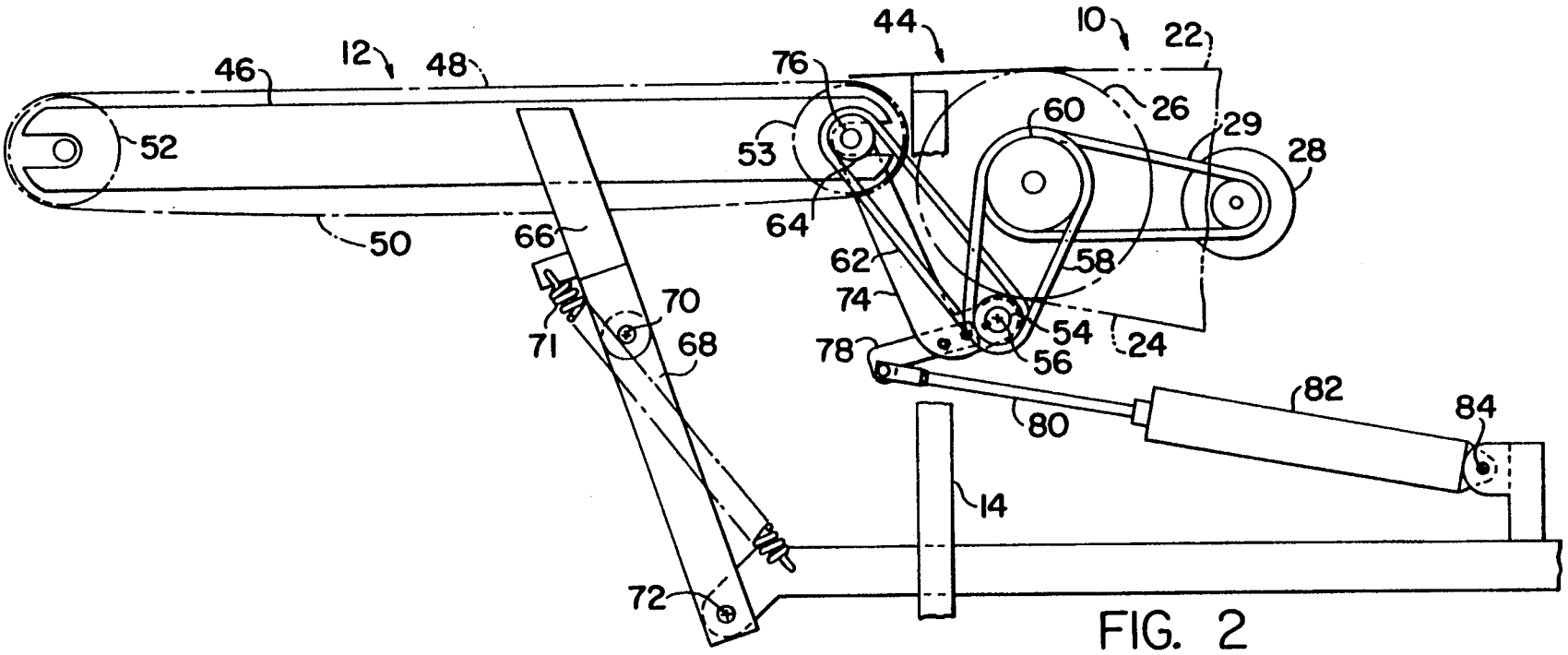
FIG. 2 is a fragmentary side view of the apparatus of FIG. 1 showing the linkage means connecting the take-off table to the cutting machine.

The frame 14 of the cutting machine 10 carries a means providing an upwardly facing flat supporting surface 22 located in a horizontal plane for supporting sheet material to be cut. In the illustrated case the means providing the supporting surface 22 is an endless conveyor member 24 trained over rotatable end units located at opposite ends of the frame 14, one of which end units is shown schematically at 26 in FIG. 2, so as to have an upper run defining the supporting surface 22. The end units include suitable sprockets positively engaging the conveyor member 24 so that the end units and conveyor member are constrained to move in unison with one another. As shown in FIG. 2, the illustrated end unit 26 is driven by a drive motor 28 drivingly connected with the illustrated end unit by a positive drive power transmitting means such as the illustrated one including a toothed belt or chain 29 cooperating with suitable sprockets fixed to the drive shaft of the motor and to the end unit 26.

The conveyor member 24 moves in the direction indicated by the arrow M of FIG. 1 parallel to the illustrated X coordinate direction upon normal forward operation of the drive motor 28. The conveyor member may take many different forms but as illustrated it is comprised of a number of slats 27 extending in the Y coordinate direction transversely of the frame 14 and linked to one another about hinge axes also extending transversely of the frame to form a continuous chain. Each slat 27 carries a number of bristle blocks 29 which when positioned in the upper run of the conveyor member 24 have upwardly extending bristles terminating in a common plane to form the supporting surface 22. The bristles therefore form a bed which is penetrable by a cutting knife and which also may be used to contain a vacuum pressure communicated to the supporting surface 22 to aid in holding and compressing the material to be cut.

The material to be cut may consist of a single layer of spread fabric or other sheet material, but in the illustrated case of FIG. 1 is shown to comprise a lay-up 30 consisting of a number of sheets of fabric or other sheet material spread on top of one another. Spread over the top of the lay-up 30 is a sheet 31 of thin air impermeable material which cooperates in a well known way with a vacuum applied to the supporting surface 22 to compress the material of the lay-up 30 against the supporting surface to condition it for better cutting.

For the cutting of the work material supported by the supporting surface 22, the cutting machine includes a cutting head 32 movable in the illustrated X and Y coordinate directions relative to the supporting surface 22 to cut two dimensional shapes, such as the illustrated pattern pieces 34, in the work material. Preferably the cutter head 32 is one having a vertically reciprocating knife which during at least a portion of its stroke has its lower end moved below the supporting surface 22 and into the bed formed by the bristles of the bristle blocks 29. The cutter head 32 is carried by a Y carriage 36 moveable in the Y coordinate direction relative to an X beam or carriage 38. The X beam 38 extends transversely over the supporting surface 22 and is supported at its opposite ends by guide rails 40 fixed relative to the machine frame 14 and extending longitudinally thereof in the X coordinate direction. Suitable X and Y drive motors (not shown) controlled by an associated controller (not shown) drive the Y carriage 36 and X beam 38 in the X and Y coordinate directions to follow the lines of cut required to produce the desired pattern pieces.

Typically, in the use of the cutting machine 10 it is moved to a spreading table having a quantity of work material ready to be cut. When reaching the spreading table, the machine 10 is positioned so that its input end, illustrated generally at 42, is located adjacent one end of the spreading table. The work material is then moved from the spreading table to the supporting surface 22 of the machine 10. In doing this, once a portion of the work material reaches the supporting surface 22 the conveyor member 24 may be driven in the direction M to aid in pulling the work material from the spreading table onto the surface 22; and also vacuum may be applied to the surface 22 to attract the work material to the surface 22, causing a more positive lock between the work material and the conveyor member 24 and thereby minimizing slippage between the work material and the conveyor member. In the illustrated case of FIG. 1 the lay-up 30 is shown to have a length less than the length of the supporting surface 22 and to have been moved all at once onto the supporting surface 22. However, in other cases the work material may have a length longer than the supporting surface 22 in which event it is moved portion by portion onto the supporting surface 22 with the cutter head 32 being operated to cut the portion then on the supporting surface 22 before a new portion is advanced onto the machine.

The take-off table 12 serves to receive work material from the supporting surface 22 of the machine 10 after it has been cut by the cutter head 32. Therefore the table 12 is located at the cutting machine's discharge end indicated generally at 44. The take-off table 12 is permanently connected to the machine 10 so as to be entirely carried and supported by the machine frame 14 and so as to move with the machine as it is shifted from one spot on the floor 18 to another. As explained in more detail hereinafter, the table 12 is also movable relative to the machine frame 14 between a normal or deployed position and a stowed position.

FIGS. 1 and 2 show the table 12 in its deployed position. As so positioned, the table includes a frame 46 carrying a means providing an upwardly facing flat supporting surface 48 located in, or at least substantially in, the same horizontal plane as the machine's supporting surface 22. The take-off table supporting surface 48 therefore essentially forms a continuation of the machine's supporting surface 22 so that after work material has been cut by the cutting machine it may easily be transferred to the supporting surface of the cutting table by moving it forwardly in the direction of the arrow M.

The take-off table supporting surface 48 may be formed in many different ways, but preferably and as shown it is also provided by an endless conveyor member 50 trained about two end units 52 and 53 (FIG. 2) rotatably carried by the frame 46 so that the supporting surface 48 is formed by the upper run of the member 50. The endless conveyor member 50 need not, however, form a penetrable bed and preferably, it is comprised of a large number of plastic links hingedly connected to one another about hinge axes extending transversely of the table 12 in the Y coordinate direction. A continuous fabric belt may also be used as the endless conveyor member 50.

Referring to FIG. 2, the endless conveyor member 50 of the take-off table 12 is driven simultaneously with the conveyor member 24 of the machine 10 by the drive motor 28. For this purpose, the end unit 53 of the take-off table 12, as seen in FIG. 2, is drivingly connected with the adjacent end unit 26 of the machine 10. The machine frame 10 supports a torsion shaft 54 for rotation about an axis 56 extending transversely of the machine frame 14 in the Y coordinate direction and fixed relative to the machine frame. A pair of idler sprockets rotatably fixed relative to one another are carried by this torsion shaft 54 and are rotatable relative to the shaft 54 about its axis 56. One of these sprockets cooperates with a toothed belt or chain 58 which also passes over another sprocket 60 fixed to the end unit 26 so that the pair of sprockets on the torsion shaft 54 are driven simultaneously with the rotation of the end unit 26. The other sprocket of the pair on the torsion shaft 54 cooperates with another toothed belt or chain 62 also passing over a sprocket 64 fixed to the end unit 53 of the take-off table 12 and in turn drives the endless conveyor member 50 of the table relative to the table frame 46. From this it will be understood that the belts or chains 58 and 62 and their associated sprockets cause the upper run of the take-off table conveyor member 50 to be moved in the same direction as and simultaneously with the upper run of the machine's conveyor member 24. The drive ratio may be such that the conveyor member 50 of the table and the conveyor member 24 of the machine move at the same speed, but preferably it is such that the conveyor member 50 of the table moves at a slightly greater speed than the machine's conveyor member 24.

From the deployed position of the table 12 shown in FIGS. 1 and 2, it is movable to a stowed position shortening the overall length of the apparatus to make it more easily movable from one location to another. To permit this change in position of the take-off table, it is connected to the machine frame 14 by a linkage means as shown in FIG. 2 and FIGS. 3A to 3D. Referring first to FIG. 2, this figure shows a half of the linkage means which is located on one side of the machine 10, and another identical half of the linkage means is located (but not shown) on the other side of the machine. The half of the linkage means seen in FIG. 2 includes a generally downwardly extending arm 66 fixed to the take-off table frame 46 and pivotally connected to the upper end of a link 68 for movement about a transversely extending hinge axis 70. The lower end of the link 68 is connected to the machine frame 14 for movement about another transversely extending hinge axis 72. A second link 74 is also connected between the machine frame 14 and the table frame 46. This link 74 has its upper end pivotally connected to the table frame 46 by being rotatably received on the same shaft 76 as carries the table end unit 53. The lower end of the link 74 is received on the torsion shaft 54 carried by the machine frame 14. Also received on the torsion shaft 54 is a crank 78 having its outer end pivotally connected to the outer end of the piston rod 80 of a pneumatic actuator 82, the base end of which is pivotally connected to the machine frame 14 for movement about a transversely extending axis 84. The crank 78 is non-rotatably fixed to the link 74 as by non-rotatably fixing both the crank 78 and the link 74 to the torsion shaft 54.

The air cylinder 82, though the crank 78, rotates the link 74 about the axis 56 of the torsion shaft 54 and in so doing moves the table 12 between its deployed and stowed positions.

The arrangement of the parts of the take-off table 12 and of the linkage connecting it to the machine 10 in the illustrated embodiment is such that the weight of the table is not entirely balanced during the movement of the table between its deployed and stowed positions. To compensate for this unbalance, the illustrated apparatus preferably and as shown has associated with it on each of its sides a compensating helical tension spring 71 connected as shown in FIG. 2 between the machine frame 14 and the downwardly extending arm 66 of the take-off table frame 46. This spring 71 further tends to hold the take-off table 12 in both its deployed position and its stowed position to inhibit accidental movement of the take-off table from either of such positions as explained in more detail hereinafter.

Figure 3B:
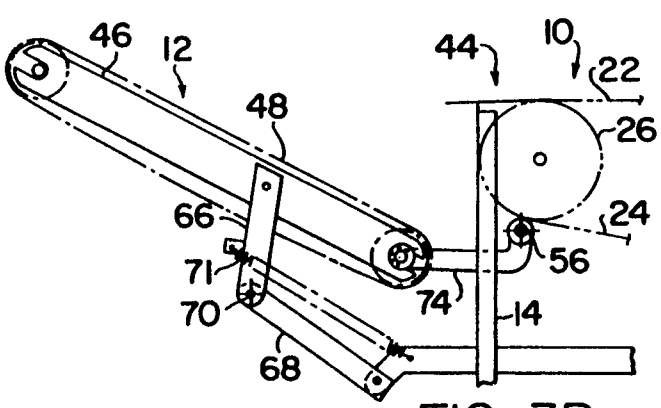
FIGS. 3A to 3D are views generally similar to FIG. 2 showing the take-off table and the linkage means at different successive stages in the movement of the take-off table from its deployed to its stowed position.
Figure 3D:
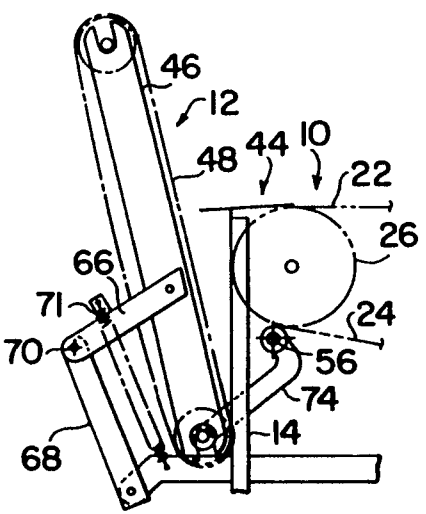
Figure 3A:
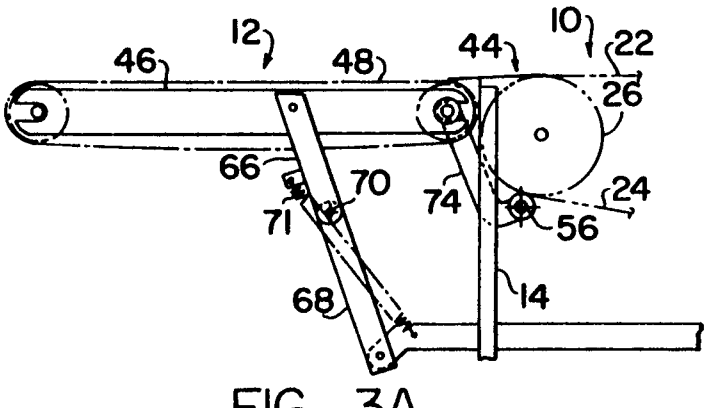
Figure 3C:
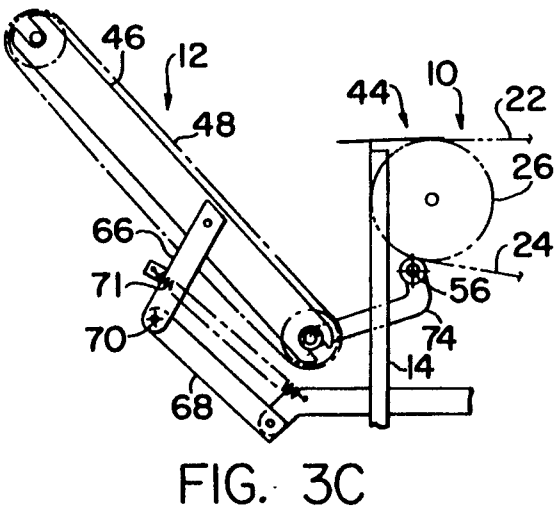

FIGS. 3A to 3D show the positions taken by various parts at various times during the movement of the table 12 between its deployed and stowed positions. FIG. 3A shows the table 12 in the same deployed position as in FIGS. 1 and 2. From this position the table 12 may be moved to its stowed position by continuous rotation of the link 74 by the air cylinder 82 in the counter-clockwise direction about the axis 56 for about 110° to the position of FIG. 3D with the parts during such a movement going through the intermediate positions of FIGS. 3B and 3C. FIG. 3D shows the stowed position of the table 12 at which the table 12 has been collapsed toward the discharge end 44 of the table with its supporting surface 48 being positioned at a substantial angle, almost a vertical angle, to the supporting surface 22 of the machine 10. It will also be noted that in this position the end of the supporting surface 48 closer to the machine 10 is located a substantial distance below the supporting surface 22 of the machine so that the upper end of the table is located at a substantially lower level than it would be if such lowering of the one end did not occur. After the apparatus has been moved to a new location the table 12 can be returned from the stowed position of FIG. 3D to the deployed position of FIG. 3A by rotating the link 74 continuously in the clockwise direction from the position of FIG. 3D to the position of FIG. 3A.

With respect to the function of the compensating spring 71, when the take-off table 12 is in the deployed position of FIG. 3A the weight distribution of the table is such that the weight tends to urge the left-hand or outer end of the table, as seen in FIG. 3A, downwardly.

Therefore during movement of the table from the deployed position of FIG. 3A to the position of FIG. 3D some force has to be applied to the table, at least during a substantial initial portion of its movement, in the direction tending to raise its left-hand end; and the spring 71 is connected between the machine frame 14 and the table frame arm 66 in such a manner as to aid in supplying this force, thereby reducing the amount of effort needed to be exerted on the table either by the air cylinders 82 or manually to move the table to its stowed position. Likewise, during the return movement of the table from the stowed position to the deployed position the compensating spring 71 exerts a counter-force on the table reducing the amount of other force needed to effect a smooth transfer from the stowed position to the deployed position.

Further, and perhaps more importantly, the compensating spring 71 tends to hold the take-off table 12 in both its deployed position and its stowed position to inhibit accidental movement from such positions. Referring to FIG. 3A, in the deployed position of the take-off table 12 the compensating spring 71 is arranged between the machine frame 14 and the table frame arm 66 as shown so that the hinge axis 70 between the arm 66 and link 68 is located slightly over-center with respect to the line of action of the spring. Further, a suitable stop means (not shown), such as coengaging stop surfaces between the frame 14 and link 68, are provided to limit the movement of the link 68 in the clockwise direction to the position shown in FIG. 3A. The force exerted on the arm 66 by the spring 71 therefore tends to hold the table 12 in the position shown in FIG. 3A, with the spring resisting movement of the table to the deployed position during a very small initial portion of its movement away from the deployed position of FIG. 3A until the hinge axis 70 passes to the other side of the line of action of the force exerted by the spring on the arm 66. Thereafter, the spring 71 aids the movement of the table to the positions of FIG. 3B, FIG. 3C and FIG. 3D. In the final stowed position of FIG. 3D the spring 71 aids in holding the table 12 in that position and yieldably resists its movement toward the deployed position.

As mentioned, various changes and deviations from the above described embodiment of the invention may be made without departing from the broader aspects of the invention. For example, the take-off table may be provided with its own drive motor and related mechanism for driving its conveyor member 50 in the event motion of the conveyor of the take-off table is desired independently of the movement of the conveyor of the cutting machine. Also, in some instances it may be desired to provide the take-off table 12 with a non-conveyorized supporting surface with the material discharged by the cutting machine being merely slid over the supporting surface of the take-off table to bring it to its desired position on the take-off table. Further, in some instances where the take-off table is relatively light weight the actuators for moving the table between its deployed and stowed positions may be omitted with the movement of the table being effected by manual effort. Also, other ways of moving the take-off table between deployed and stowed positions may be provided. That is, the take-off table 12 may be connected to the cutting machine 10 so as to swing about only a single horizontal pivot axis relative to the machine instead of being connected to the machine by a linkage. Also, the take-off table 12 may be connected, either by a linkage mechanism or a single pivot axis connecting means, to the machine 10 so as to swing laterally of the machine 10 in a generally horizontal plane between its deployed and stowed positions. The take-off table 12 may also be provided with legs engagable with the floor 18 in the deployed position of the table to aid in supporting the weight of the table. If such legs are provided they are preferably movable relative to the take-off table frame 46 so as to be shiftable to a stowed position relative to said frame 46 when the table 12 is stowed relative to the machine 10.

I claim:

1. A combined sheet material cutting machine and take-off table comprising:

a sheet material cutting machine including a machine frame and means carried by said machine frame providing an upwardly facing flat horizontal first supporting surface having first and second ends for supporting sheet material to be cut, a take-off table including a take-off table frame and means carried by said take-off table frame providing a second flat supporting surface having first and second ends for supporting sheet material cut by said cutting machine, and a connecting means connecting said take-off table frame to said machine frame for movement of said take-off table relative to said cutting machine between a deployed position and a stowed position, said take-off table in said deployed position being so positioned relative to said cutting machine that said second supporting surface is located adjacent to and co-planar with said first supporting surface with said first end of said second supporting surface being adjacent to said second end of said first supporting surface so as to essentially form a continuation of said first supporting surface, and said take-off table in said stowed position being so positioned that said second supporting surface is inclined to said first supporting surface with one of said ends of said second supporting surface being located below said first supporting surface and with the other of said ends of said second supporting surface being located above said first supporting surface and with the length of said combined cutting machine and take-off table as measured horizontally between said first end of said first supporting surface and said second end of said second supporting surface being substantially shorter than it is when said take-off table is in said deployed position.

2. A combined cutting machine and take-off table as defined in claim 1 further characterized by:

said connecting means being a linkage means including at least one first link connected between said machine frame and said take-off table frame for movement relative to said machine frame about a first axis fixed relative to and extending transversely of said machine frame and for movement relative to said table frame about a second axis fixed relative to and extending transversely of said table frame, and at least one second link connected between said machine frame and said take-off table frame for movement relative to said machine frame about a third axis fixed relative to and extending transversely of said machine frame and for movement relative to said table frame about a fourth axis fixed relative to and extending transversely of said table frame.

3. A combined cutting machine and take-off table as defined in claim 1 further characterized by:

said means carried by said cutting machine frame being a conveyor means having an endless conveyor member with an upper run providing said first supporting surface, said means carried by said take-off table frame being a conveyor means having an endless conveyor member with an upper run providing said second supporting surface, a drive motor carried by said cutting machine frame, and drive means connected between said drive motor and both of said first and second conveyor means for driving both of said first and second conveyor means simultaneously in response to operation of said drive motor.

4. A combined cutting machine and take-off table as defined in claim 3 further characterized by:

said means carried by said take-off table frame including an end unit rotatable relative to said take-off table frame about said second axis and over which said endless conveyor member of said take-off table frame drivingly passes, and said drive means including a first pulley fixed relative to said end unit for rotation with said end unit about said second axis, a second pulley rotatable about said first axis, a drive belt trained over said first and second pulleys, and means connected between said second pulley and said drive motor for rotating said second pulley about said first axis in response to operation of said motor.

5. A combined sheet material cutting machine and take-off table comprising:

a sheet material cutting machine including a machine frame and means carried by said machine frame providing an upwardly facing flat horizontal first supporting surface for supporting sheet material to be cut, a take-off table including a take-off table frame, and means carried by said take-off table frame providing a second flat supporting surface for supporting sheet material cut by said cutting machine, a connecting means connecting said take-off table frame to said machine frame for movement of said take-off table relative to said cutting machine between a deployed position and a stowed position, said take-off table in said deployed position being so positioned relative to said cutting machine that said second supporting surface is located adjacent to and co-planar with said first supporting surface so as to essentially form a continuation of said first supporting surface, and said take-off table in said stowed position being so positioned that the horizontal length of said combined cutting machine and take-off table is substantially shorter than it is when said take-off table is in said deployed position, and a compensating spring connected between said machine frame and said take-off table frame to aid in the movement of said take-off table from said deployed position to said stowed position throughout at least a major portion of the travel of said take-off table from said deployed position to said stowed position.

6. A combined sheet material cutting machine and take-off table as defined in claim 5 further characterized by:

means for limiting to said deployed position the movement of said take-off table frame in the direction corresponding to movement of said take-off table from said stowed position to said deployed position, and said compensating spring being so connected between said machine frame and said take-off table frame as to yieldably resist movement of said take-off table away from said deployed position during a small initial portion of its movement from said deployed position to said stowed position and to thereafter urge said take-off table toward said stowed position.

* * * * *